US006870938B2

(12) United States Patent
Takeuchi et al.

(10) Patent No.: US 6,870,938 B2
(45) Date of Patent: Mar. 22, 2005

(54) SEMICONDUCTOR ELECTRET CAPACITOR MICROPHONE

(75) Inventors: Takanobu Takeuchi, Tokyo (JP); Yoshiaki Ohbayashi, Osaka (JP); Mamoru Yasuda, Osaka (JP); Shinichi Saeki, Osaka (JP)

(73) Assignees: Mitsubishi Denki Kabushiki Kaisha, Tokyo (JP); Hosiden Corporation, Yao (JP)

( * ) Notice: Subject to any disclaimer, the term of this patent is extended or adjusted under 35 U.S.C. 154(b) by 31 days.

(21) Appl. No.: 09/926,429

(22) PCT Filed: Apr. 19, 2001

(86) PCT No.: PCT/JP01/03371

§ 371 (c)(1),
(2), (4) Date: Oct. 31, 2001

(87) PCT Pub. No.: WO01/82649

PCT Pub. Date: Nov. 1, 2001

(65) Prior Publication Data

US 2002/0172384 A1 Nov. 21, 2002

(30) Foreign Application Priority Data

Apr. 26, 2000 (JP) ..... 2000-125399

(51) Int. Cl.[7] ..... H04R 25/00

(52) U.S. Cl. ..... 381/175; 381/113; 381/191

(58) Field of Search ..... 381/113, 173, 381/174, 175, 176, 191, 369; 307/400

(56) References Cited

U.S. PATENT DOCUMENTS 3,775,572 A * 11/1973 Ishibashi et al. ..... 381/175
3,786,495 A * 1/1974 Spence ..... 381/191
3,835,264 A * 9/1974 Overby ..... 381/175
4,993,072 A * 2/1991 Murphy ..... 381/191

* cited by examiner

*Primary Examiner*—Suhan Ni
(74) *Attorney, Agent, or Firm*—Armstrong, Kratz, Quintos, Hanson & Brooks, LLP

(57) ABSTRACT

A semiconductor electret capacitor microphone includes a vibration membrane, a semiconductor chip on which are formed a necessary electronic circuit, a fixed electrode, a spacer for preserving a predetermined space between the fixed electrode and the vibration membrane, and a case for enclosing the semiconductor chip and the vibration membrane in such a configuration that the fixed electrode is connected to the ground and the vibration membrane is connected to an input electrode of the semiconductor chip.

9 Claims, 12 Drawing Sheets

SEMICONDUCTOR ELECTRET CAPACITOR MICROPHONE

TECHNICAL FIELD

The invention relates to a semiconductor electret capacitor microphone.

BACKGROUND ART

A prior art type of this semiconductor electret capacitor microphone is roughly comprised of a semiconductor chip, a vibration membrane opposite a fixed electrode formed on the semiconductor chip, and a case for enclosing the semiconductor chip and the vibration membrane. On the semiconductor chip, a necessary electronic circuit is formed and also the fixed electrode is formed on an insulating layer formed on the surface thereof. This semiconductor chip has a spacer formed thereon.

The vibration membrane is attached to a ring-shaped vibration-membrane ring and assembled in such a state that it is spaced through the spacer from the fixed electrode by a predetermined distance. On a face of this vibration membrane opposite the fixed electrode is formed an electret layer, between which and the fixed electrode is constituted a capacitor.

The above-mentioned prior art semiconductor electret capacitor microphone, however, has the following problems.

That is, since as shown in FIG. 12 a fixed electrode 110 formed on a semiconductor chip is connected to an input electrode thereof (gate of an FET shown in FIG. 12) and a vibration membrane 200 is connected to the ground, respectively, a parasitic capacitance C of a few tens of pico-farads is generated below the fixed electrode 110. This parasitic capacitance C is larger than a capacitance (2 pF) of the capacitor to thus generate large noise in an output, resulting in a problem of a droop of 20 dB in sensitivity as compared to the prior art semiconductor electret capacitor microphone.

In view of the above, it is an object of the invention to provide a semiconductor electret capacitor microphone that can greatly improve a noise level.

DISCLOSURE OF THE INVENTION

A semiconductor electret capacitor microphone according to the present invention includes a vibration membrane and a semiconductor chip on which are formed a necessary electronic circuit, a fixed electrode, and a spacer for giving a predetermined spacing between the fixed electrode and the vibration membrane in such a configuration that the fixed electrode is connected to the ground and the vibration membrane is connected to an input electrode of the semiconductor chip.

DESCRIPTION OF THE REFERENCE NUMERALS

Figure 1:
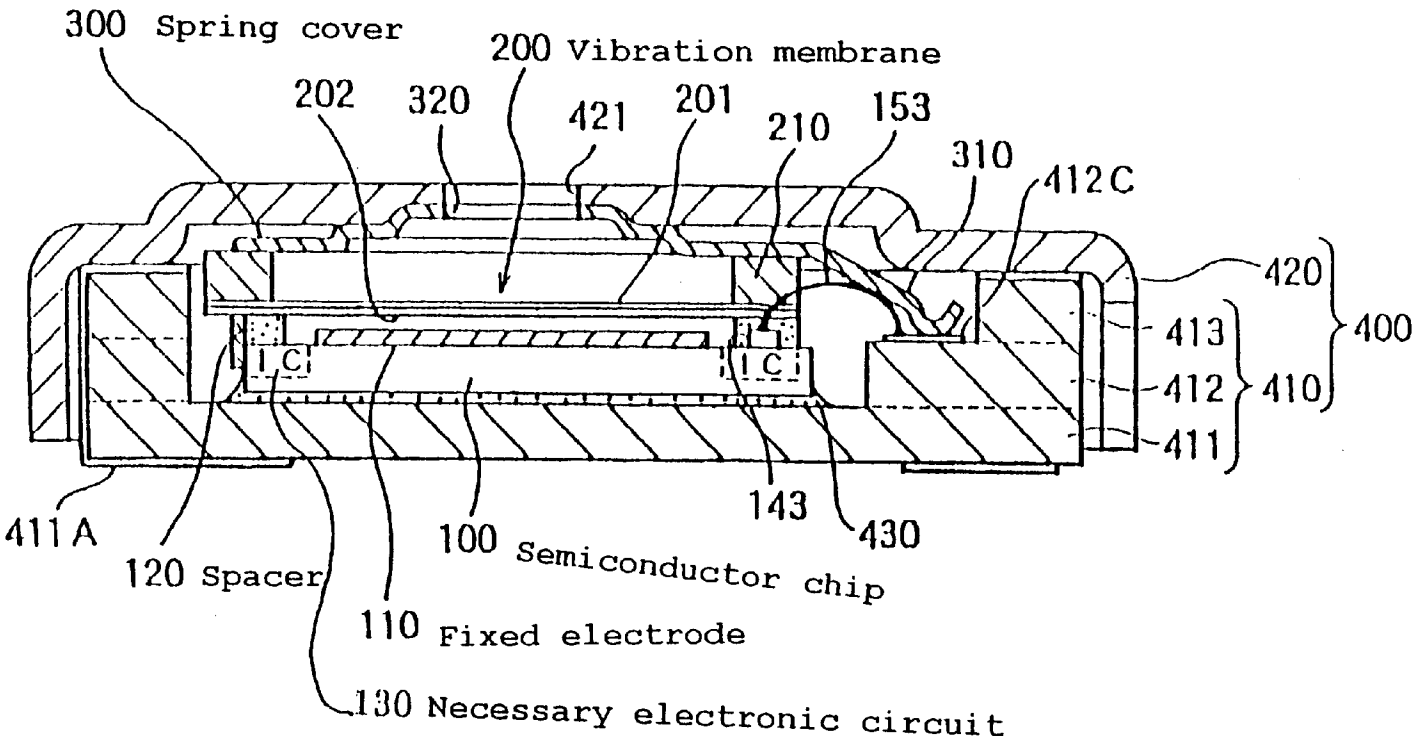
FIG. 1 is a schematic cross-sectional view for showing a semiconductor electret capacitor microphone according to an embodiment of the present invention.
Figure 2:
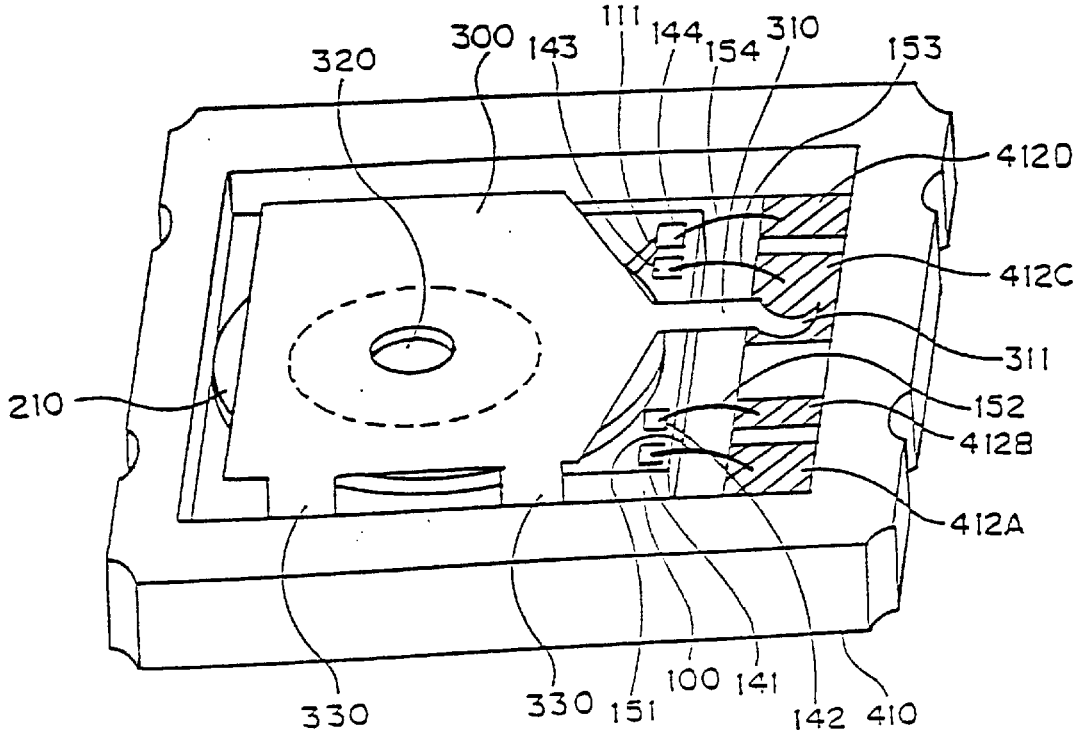
FIG. 2 is a schematic perspective view for showing a state where a lid of a case of the semiconductor electret capacitor microphone according to the embodiment of the invention is removed.

| | |
|---|---|
| 100 | semiconductor chip |
| 110 | fixed electrode |
| 120 | spacer |
| 130, 130' | necessary electronic circuit |
| 2 | nose canceller circuit |
| 200 | vibration membrane |
| 300 | spring cover |

BEST MODE FOR CARRYING OUT THE INVENTION

The following will describe a semiconductor electret capacitor microphone according to embodiments of the invention with reference to FIGS. 1–5. This microphone includes a vibration membrane 200 and a semiconductor chip 100 on which are formed a necessary electronic circuit 130, a fixed electrode 110, and a spacer 120 for preserving a predetermined spacing between the fixed electrode 110 and the vibration membrane 200, in such a configuration that the fixed electrode 110 is connected to a ground electrode 144 for providing a ground potential and the vibration membrane 200 is connected to an input electrode 143 of the semiconductor chip 100.

To begin with, the semiconductor chip 100 is made of silicon and has a size of 2.0 mm×2.0 mm×0.3 mm. As indicated by a broken line in FIG. 3, on the periphery of the semiconductor chip 100 is formed, by an ordinary method, the necessary electronic circuit 130 comprised of an impedance-conversion FET, an amplifier circuit, and a noise canceller circuit.

Figure 3:
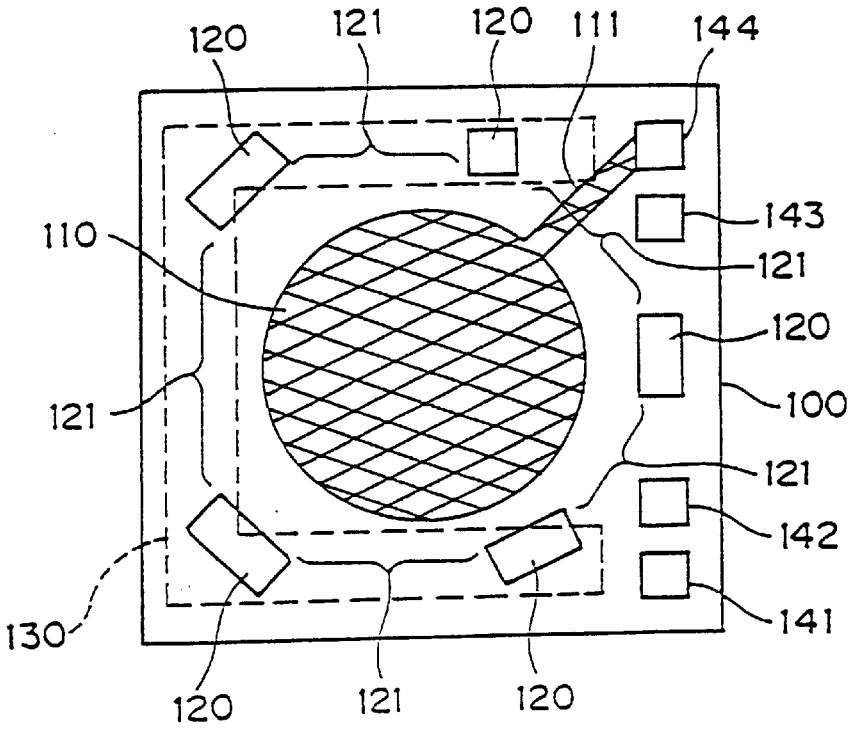
FIG. 3 is a schematic plan view for showing a semiconductor chip used in the semiconductor electret capacitor microphone according to the embodiment of the invention.
Figure 4:
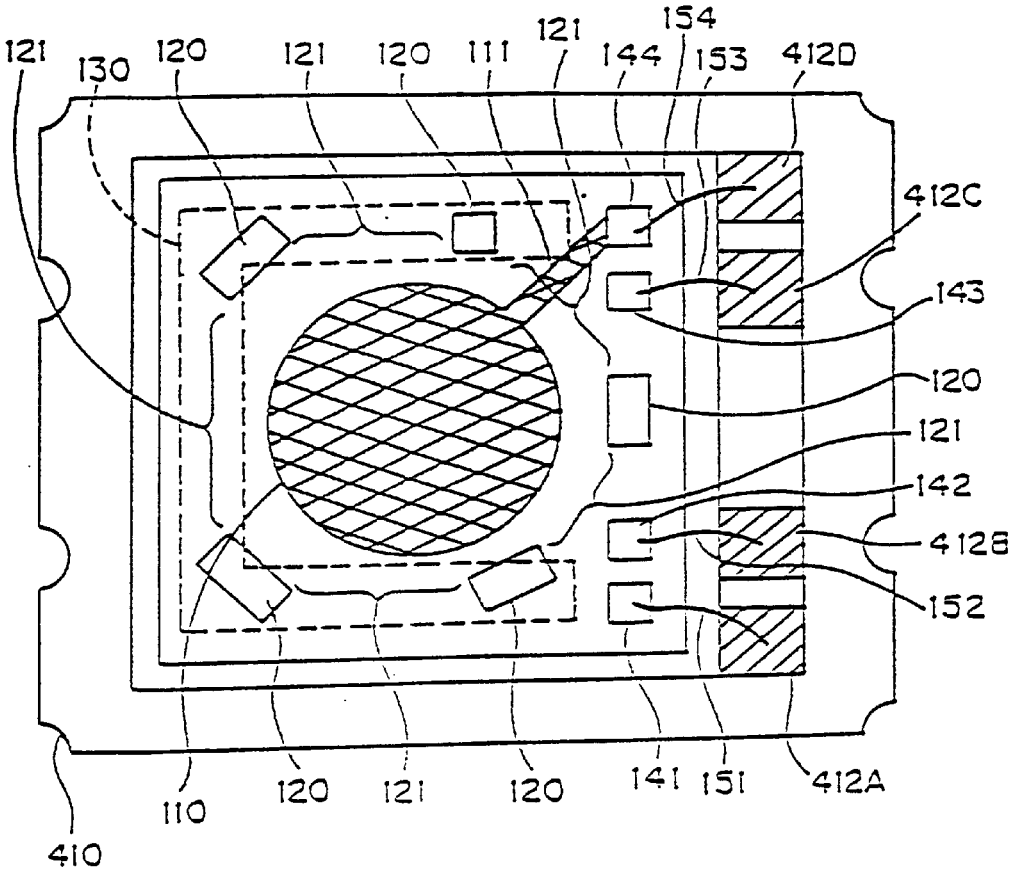
FIG. 4 is a schematic plan view for showing a state where the lid of the case and a spring cover of the semiconductor electret capacitor microphone.

As shown in FIG. 3 and the like, on the right surface of the semiconductor chip 100 is stacked an insulating layer (not shown) except on the input/output electrodes of the electronic circuit 130. The insulating layers is obtained by applying a $SiO_2$-based film-forming agent (TEOS) having an organic silicon compound or stabilizer dispersed in an organic solvent such as alcohol or ester using such a proper method as a dip coating method, a spin-on-coat method, or a spray coating method. Such an insulating layer is formed to a thickness of at least 0.1 $\mu$m or larger,-preferably a thickness of a few tens of micrometers. Note here that by applying a $SiO_2$-based film-forming agent by the dip coating method and the like, an insulating layer with a thickness of 0.1 $\mu$m or larger can be formed easily.

Figure 5:
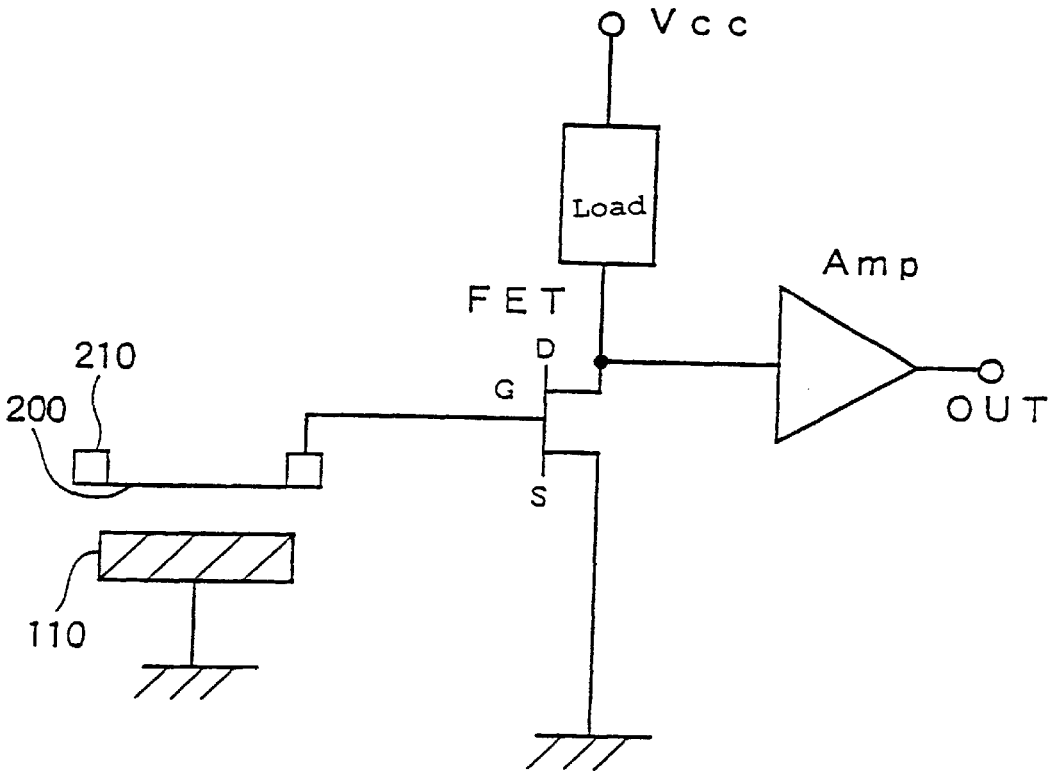
FIG. 5 is an equivalent circuit diagram for showing the semiconductor electret capacitor microphone according to the embodiment of the invention.

The electrodes include a power-supply electrode 141, an output electrode 142, the input electrode 143, and the ground electrode 144. Of these, the input electrode 143 is as shown in FIG. 5, connected to the gate of an FET (one element of the necessary electronic circuit 130).

Also, on the right surface of the insulating layer, the fixed electrode 110 is formed. This fixed electrode 110 is made up of an aluminum layer with a thickness of 1000 Å or so, on which a thin insulating layer ($TiO_2$) is formed. This fixed electrode 110 is connected through its own extension 111 to the ground electrode 144 at the ground potential.

Also, on the insulating layer, a plurality (five in the figure) of the spacers 120 is formed in such a manner as to surround the fixed electrode 110, so that those spacers 120 may be combined with the vibration membrane 200 to form a plurality (five in the figure) of openings 121. As shown in FIG. 3 and the like, this opening 121 provides a space between the adjacent spacers 120. The spacer 120 is made of a poly-imide resin. The spacer 120 is preset thicker than the fixed electrode 110. This is because the spacer 120 is supposed to preserve a predetermined space between the vibration membrane 200 described later and the fixed electrode 110.

Note here that the spacer 120 is formed by a photo-engraving process, which is one process for manufacturing a semiconductor device. It is formed, for example, by a photo-engraving process during a step of forming a poly-imide film, which is a passivation film of a semiconductor device.

The vibration membrane 200 consists of such a polymeric FEP film that one surface thereof has a metallic electrode 201 formed thereon and the other surface has an electret layer 202 formed thereon. Specifically, on the right side of the polymeric FEP film with a thickness of 5–12.5 $\mu$m, nickel is evaporated to a thickness of 500 Å or so to provide the metallic electrode 201. Then, on the side on which the metallic electrode 201 is not formed, that is, on the back surface the polymeric FEP film is permanently charged electrically by corona application, EB application, or any other polarization to thereby form the electret layer 202.

Thus configured vibration membrane 200 is attached to a ring-shaped conductive vibration-membrane ring 210 using a conductive epoxy resin. Then, the metallic electrode 201 of the vibration membrane 200 comes in contact with the vibration-membrane ring 210. This means that the vibration-membrane ring 210 to which the vibration film 200 is attached, that is, the non-movable portion of the vibration membrane, is in contact with the spacer 120. With this, the space between the adjacent spacers 120 provides the opening 121. Note here that brass, stainless steel, and the like is suitable as the material of the vibration-membrane ring 210.

Onto this vibration membrane 200, a spring cover 300 made of conductive metal is mounted. This spring cove 300 has a sound pore 320 formed at its middle and a pendulous strip 330 (see FIG. 2) pending from its periphery. The spring cover 300 also has a protruding arm 310. When the spring cover 300 is attached to a predetermined position, a tip 311 of this arm 310 comes in contact with an intermediate terminal 412C formed on a case 400 described later. Moreover, the tip 311 of the arm 310 is folded in formation so as to be convex downward in order to further secure its contact with the intermediate terminal 412C.

Also, the surface of the spring cover 300 is covered by an insulating coating (not shown). Further, the surface of the spring cover 300 is formed in steps in such a manner as to rise up in level toward the middle. This is done so that when a lid 420 is attached onto a body 410 of the case 400 the spring cover 300 may be pressed by the lid 420 to thereby further heavily press down the vibration-membrane ring 210.

The case 400, on the other hand, includes the body 410 for enclosing the semiconductor chip 100 and the like, and the lid 420 for covering the body 410. The body 410 has a base 411, a roughly casing-shaped first frame 412 stacked on the base 411, and a roughly casing-shaped second frame 413 stacked on the first frame 412. The base 411, the first frame 412, and the second frame 413 are all made of ceramic.

The base 411 constitutes a bottom of the body 410 and so is formed flat. Also, on the bottom and one side surface of the base 411 are formed by gold plating and the like thin-film electrodes used for connection with a land or the like of a printed-circuit board, not shown, in bonding of the electrodes 141, 142, 143, and 144.

Also, since the first frame 412 is to be stacked on the base 411, its outer appearance is similar to that of the base 411. It has therein, however, such a space that is large enough to house the semiconductor chip 100, which is enclosed in the case 400, in its inside. Also, on the right surface of the first frame 412, that is, on the right surface exposed even when it is assembled as the body 410, are formed four gold-plated intermediate terminals 412A, 412B, 412C, and 412D connected with the electrodes 141, 142, 143, and 144 respectively. Those intermediate terminals 412A, 412B, 412C, and 412D are appropriately connected with the thin-film electrodes.

Especially, the intermediate terminal 412D, to which the fixed electrode 110 is to be connected via the extension 111, the ground electrode 144, and a bonding wire 154, is connected with a thin-film electrode which provides a grounding portion 411A formed on the back surface of the base 411.

Further, since the second frame 413 is to be stacked on the first frame 412, its outer appearance is similar to that of the first frame 412 and the base 411. It has therein, however, a space larger than that of the first frame 412.

When the base 411, the first frame 412, and the second frame 413 are stacked on another, the intermediate terminals 412A, 412B, 412C, and 412D are connected with the proper thin-film electrodes. Also, a difference in size between the inner space of the first frame 412 and that of the second frame 413 causes part of the right surface of the first frame 412, that is, part of the right surface on which the terminals 412A, 412B, 412C, and 412D are formed to be exposed roughly in a step shape.

On the other hand, the lid 420, which is to cover thus constituted body 410, is made of conductive metal. The lid 420 has a sound pore 421 formed therein at its middle which pore 421 is aligned with the sound pore 320 in the spring cover 300 when the lid 420 covers the body 410 of the case 400. Note here that although the lid 420 comes in contact with the spring cover 300 when it covers the body 410, the insulating coating formed on the lid 420 prevents short-circuiting therebetween.

The following will describe a procedure for manufacturing a semiconductor electret capacitor microphone composed of these elements.

First, the semiconductor chip 100 is fixed through a conductive epoxy resin-based adhesive agent 430 to the bottom of the body 410 of the case 400. On the semiconductor chip 100 are formed the necessary electronic circuit 130, the fixed electrode 110, the spacer 120, and the like beforehand.

The electrodes 141, 142, 143, and 144 of the semiconductor chip 100 are connected respectively to the intermediate terminals 412A, 412B, 412C, and 412D using such connection means as bonding wires 151, 152, 153, and 154. That is, the bonding wire 151 interconnects the power supply electrode 141 of the semiconductor chip 100 and the intermediate terminal 412A, the bonding wire 152 interconnects the output terminal 142 of the semiconductor chip 100 and the intermediate terminal 412B, the bonding wire 153 interconnects the input electrode 143 of the semiconductor chip 100 and the intermediate terminal 412C, and the bonding wire 154 interconnects the ground electrode 144 of the 144 of the semiconductor chip 100 and the intermediate terminal 412D.

Then, as mentioned above, the fixed electrode 110 is connected through the extension 111, the ground electrode 144, the bonding wire 154, and the intermediate 412D to a thin-film electrode which provides the grounding portion 411A formed on the back surface of the base 411.

Next, the vibration-membrane ring 210 to which the vibration membrane 200 is stacked on the-spacer 120 with the vibration membrane 200 facing downward. With this, the spacer 120 can serve to preserve between the fixed electrode 110 and the vibration membrane 200 a predetermined spacing, that is, a spacing as large as the thickness of the spacer 120.

Then, the spring cover 300 is attached to the semiconductor chip 100 to which are connected the bonding wires 151, 152, 153, and 154. With this, the metallic electrode 201 formed on the vibration membrane 200 is electrically connected through the vibration membrane 210 with the spring cover 300. Further, the spring cover 300 has the tip of its arm 310 in contact with the intermediate electrode 412C, so that the metallic electrode 201 formed on the vibration membrane 200 is electrically connected through the intermediate terminal 412C with the input electrode 143 of the semiconductor chip 100.

When the body 410 to which the members are thus attached is covered by the lid 420, the sound pore 421 formed in the lid 420 is aligned with the sound pore 320 formed in the spring cover 300. Through these sound pores 421 and 320, an external sound is transmitted to the vibration membrane 200.

Next, a variant of the semiconductor electret capacitor microphone is described with reference to FIGS. 6–11.

Figure 6:
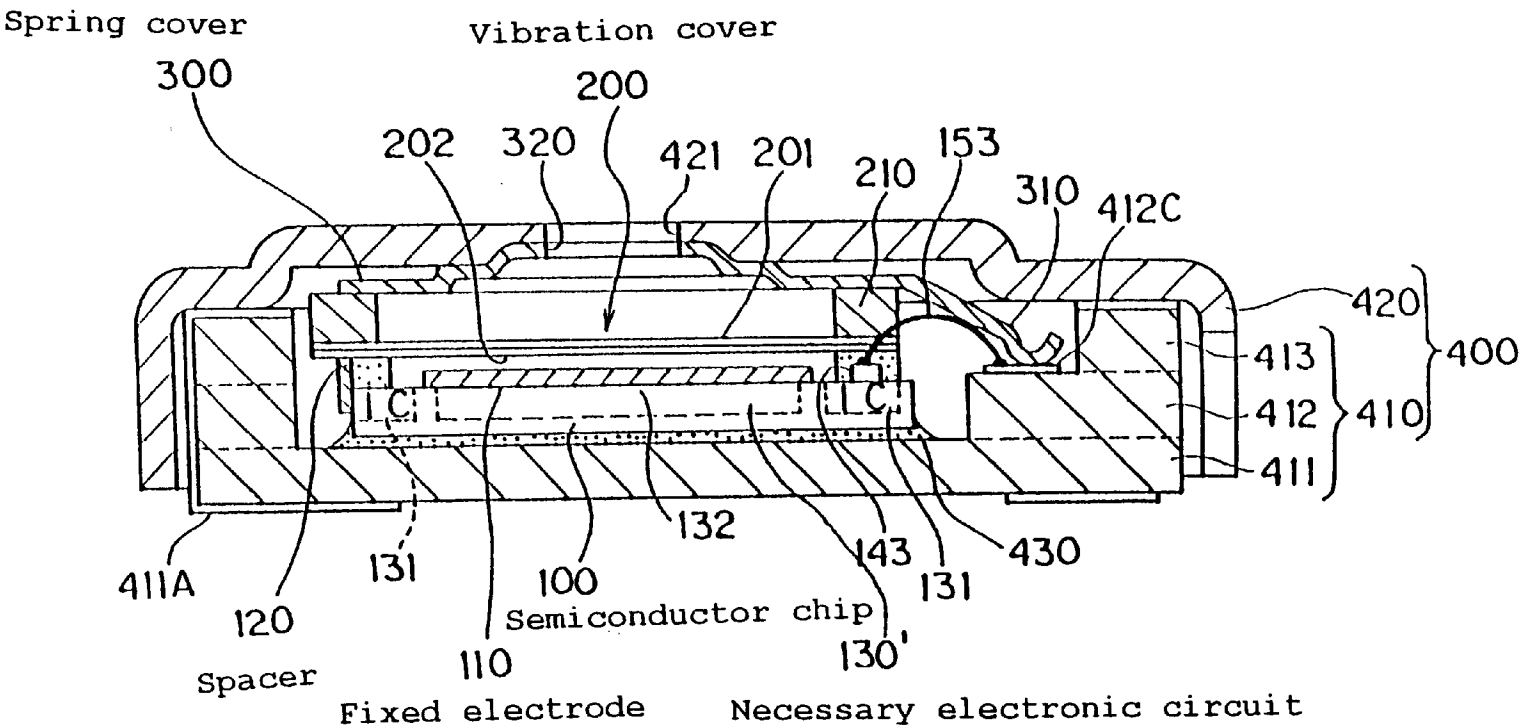
FIG. 6 is a schematic cross-sectional view for explaining a variant of the semiconductor electret capacitor microphone.

In this variant of the semiconductor electret capacitor microphone, a necessary electronic circuit 130' including an input circuit 1 (see FIG. 7), a noise canceller circuit 2 (see FIG. 7), a DC stabilizer power-supply circuit, an A/D converter circuit, and a D.S.P. circuit is formed on the semiconductor chip 100. This variant differs greatly from the above-mentioned embodiment in a respect that of these circuits the input circuit 1 and the noise canceller circuit 2 for processing a minute level signal are arranged below the fixed electrode 110, whereas the other circuits such as the A/D converter circuit are arranged at the periphery of the semiconductor chip 100. In FIG. 6, the input circuit 1, the noise canceller circuit 2, and the like are indicated by a broken line 132 and the A/D converter circuit and the like are indicated by a broken line 131.

Figure 7:
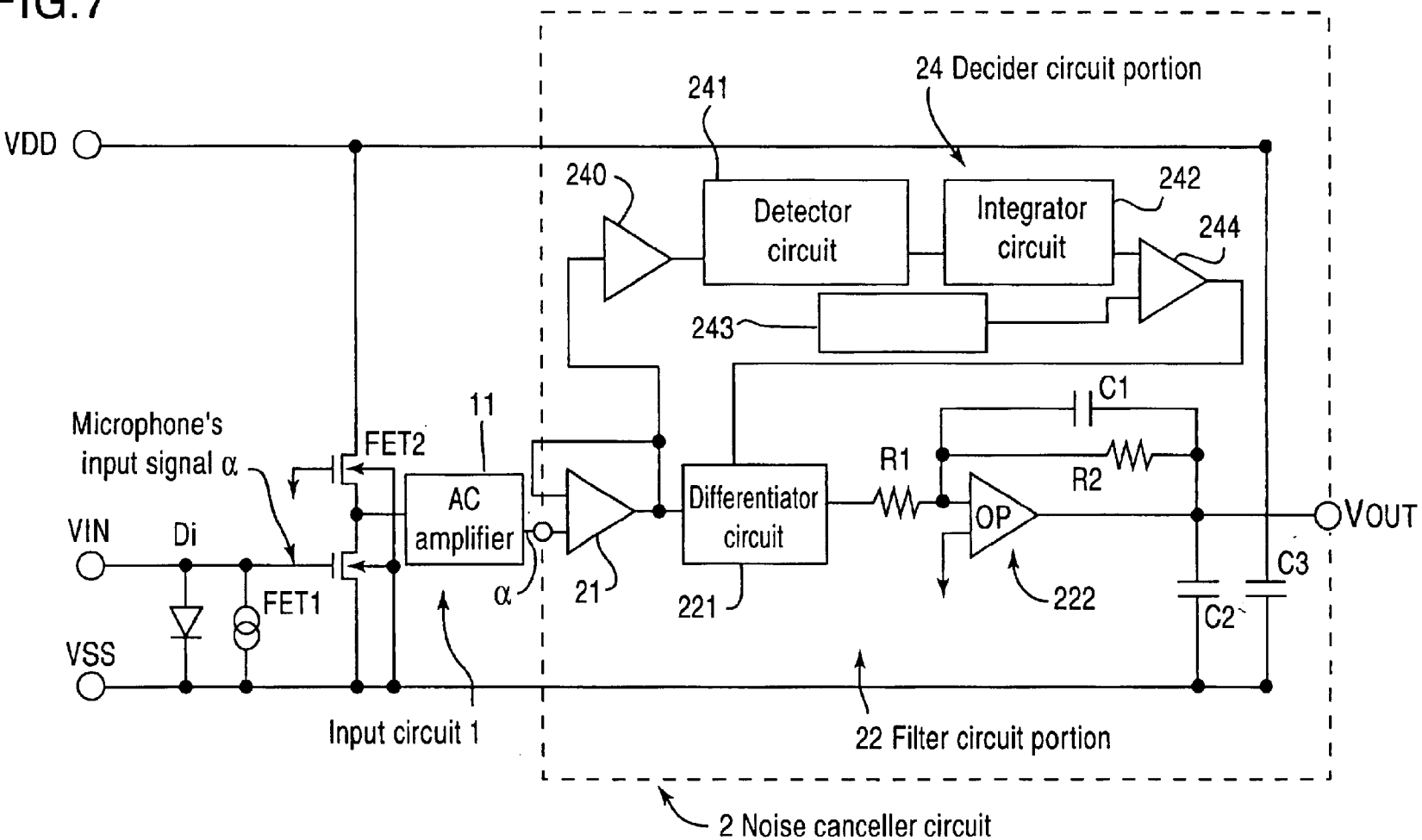
FIG. 7 is a circuit diagram for showing an input circuit and a noise canceller circuit formed on the semiconductor chip of the semiconductor electret capacitor microphone.

The input circuit 1 and the noise canceller circuit 2 are implemented in such a circuit configuration as shown in FIG. 7. In FIG. 7, $V_{IN}$ and $V_{SS}$ are input terminals which are connected to the input electrode 143 (vibration membrane 200) and the fixed electrode 110 (ground electrode 144) respectively, through which a microphone's input signal a is input to the input circuit 1.

In FIG. 7, $V_{DD}$ represents a power-supply voltage, while a diode Di and a current source connected between those input terminals give how to bias the microphone.

The input circuit 1 is a buffer amplifier circuit for amplifying the microphone's input signal α input via the input electrode 143, including FETs 1 and 2 and an AC amplifier 11 in configuration. The microphone's input signal α' amplified at the input circuit 1 is sent to the noise canceller circuit 2.

The noise canceller circuit 2 is a filter circuit for canceling noise of the microphone's input signal α', specifically canceling the wide frequency-band noise of the microphone's input signal α' when the level of the microphone's input signal α is less than a predetermined value (here, the microphone's operating voltage: 50–100 $\mu V_{O-P}$).

More specifically, in configuration, the noise canceller circuit 2 includes: a buffer amplifier 21 for receiving the microphone's input signal α'; a decider circuit portion 24 for deciding whether a level of the microphone's input signal a is at east the microphone's operating voltage; and a filter circuit portion 22 for canceling the noise of the microphone's input signal α' in various frequency bands based on a decision result of the decider circuit 24 in such a manner as to cancel the noise in the ordinary frequency band if the level of the microphone's input signal α is at least the microphone's operating voltage and, otherwise, cancel the noise in the wide frequency band including the low frequency band.

In configuration, the decider circuit portion 24 includes: an amplifier 240 for amplifying the microphone's input signal α' output from the buffer amplifier 21; a detector circuit 241 for detecting, as amplifying, an output signal of the amplifier circuit 240; an integrator circuit 242 for integrating an output signal of the detector circuit 241; a reference-voltage generator circuit 243 for generating a reference voltage set in correspondence with an output voltage of the integrator circuit 242; and a comparator 244 for comparing, in magnitude, between an output voltage of the integrator circuit 242 and a reference voltage generated by the reference-voltage generator circuit 244.

An output signal of the comparator 244 is sent to a filter circuit 122 as a decision result indicating whether the level of the microphone's input signal α' is at least the microphone's operating voltage or not. In this case, the comparator 244 places an output of level H if the level of the microphone's input signal a is at least the microphone's operating voltage and, otherwise, an output of level L.

The filter circuit portion 22 cancels noise contained in the microphone's input signal α' output from the buffer amplifier 21 and includes a differentiator circuit 221 and a filter circuit 222 which are cascade-connected in configuration. The microphone's input signal α' which passed through the filter circuit portion 22 is sent as an output voltage $V_{OUT}$ to the A/D converter circuit and the like.

The filter circuit 222 has a filter frequency response determined by an RC circuit (resistors: R1 and R2, capacitors: C1 and C2) and the like connected at the periphery of the operational amplifier OP. This is basically true also with the differentiator circuit 221. One difference is that the connection relation of the RC circuit of the differentiator circuit 221 is switched by a switching element such as an FET turned ON/OFF according to the output signal of the comparator 244, thus resulting in variable-ness of the filter frequency response.

Figure 8:
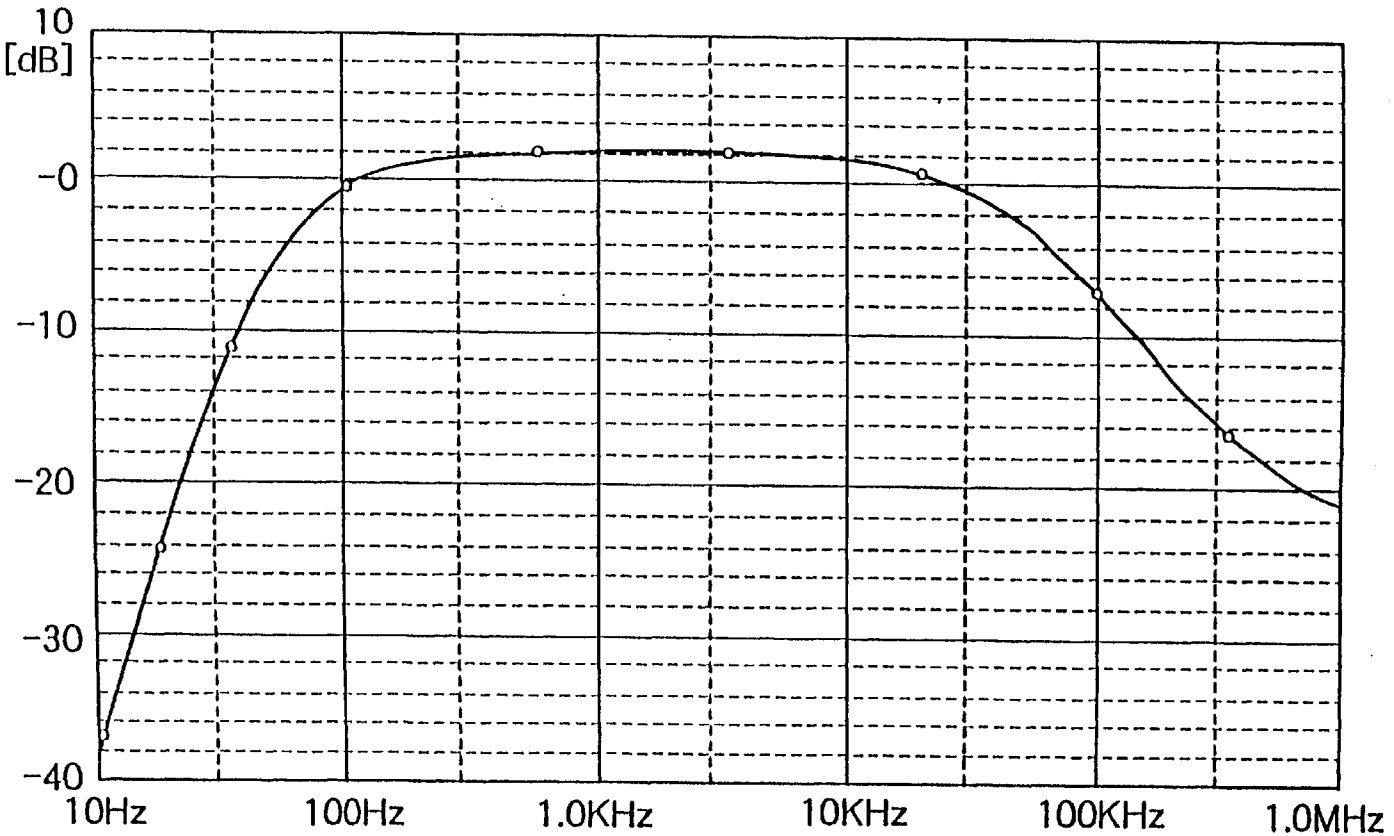
FIG. 8 is a graph for describing operations of a filter circuit portion of the noise canceller circuit, specifically indicating a frequency response when a level of a microphone's input signal is not lower than a microphone's operating voltage.
Figure 9:
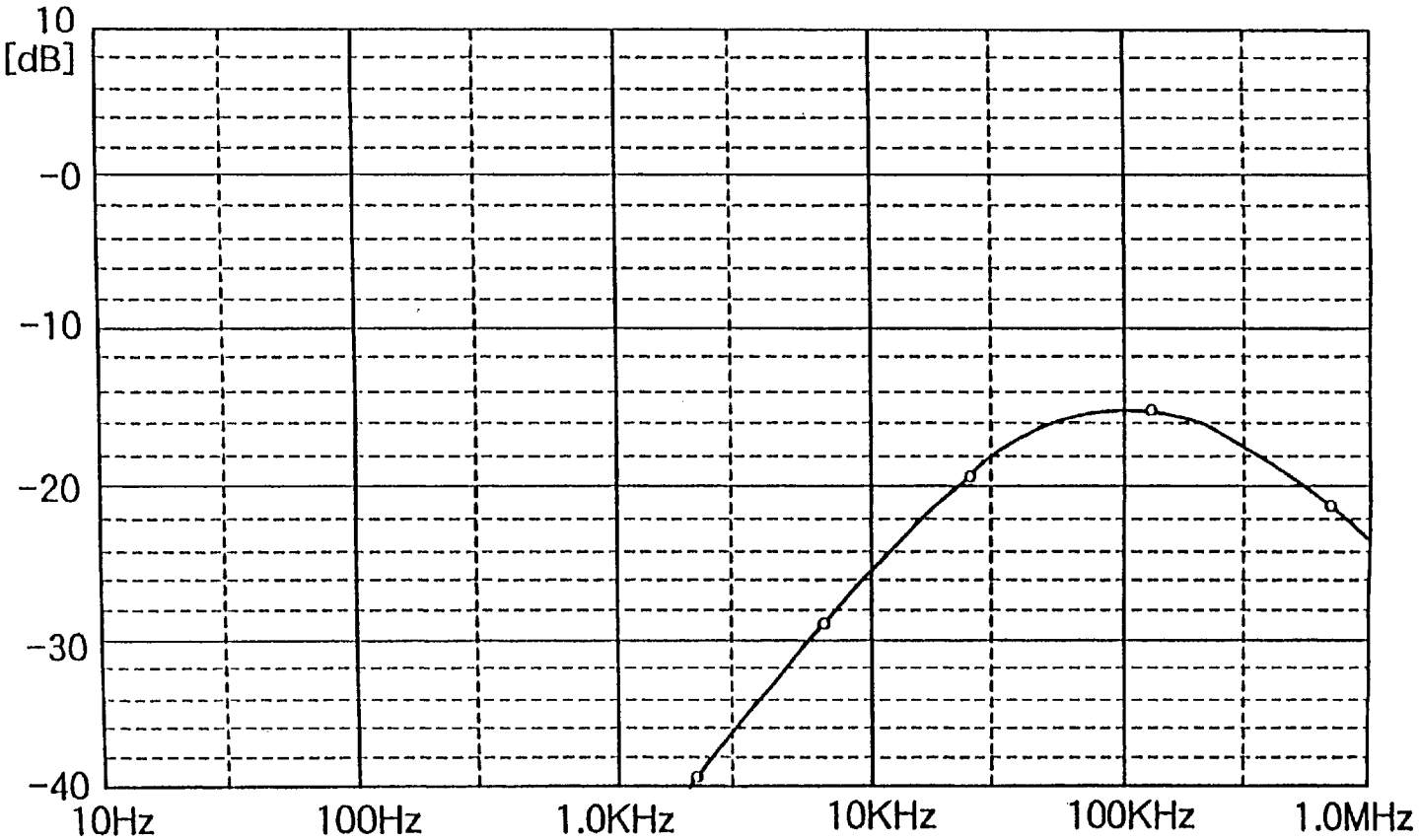
FIG. 9 is a graph for describing operations of the filter circuit portion of the noise canceller circuit, specifically indicating a frequency response when the level of the microphone's input signal is lower than the microphone's operating voltage.

The filter frequency response of the filter circuit portion 22 as a whole is determined by a frequency response of the differentiator circuit 221 and that of the filter circuit 222. That is, if the decider circuit portion 24 decides that the level of the microphone's input signal α is at least the microphone's operating voltage, the filter circuit portion 22 provides band pass filter for such a frequency band of 100 Hz through 15 kHz as shown in FIG. 8, which is an ordinary frequency response of the microphone. If the decider circuit portion 23 decides that the level of the microphone's input signal α is less than the microphone's operating voltage, on the other hand, it provides a filter for a wide frequency band including a low frequency band of 100 Hz through 15 kHz.

The operations of thus constituted noise canceller circuit 2 are described as follows with respect to FIGS. 10 and 11. First, as shown at the highest part of in FIG. 10, if the level of the microphone's input signal α is at least the microphone's operating voltage (50–100 $\mu V_{O-P}$), in a time lapse of about 3 ms from the inputting of this signal, an output voltage of the integrator circuit 242 exceeds the reference voltage, so that the output of the comparator 244 is changed from level L to level H (see the middle part in FIG. 10).

Figure 10:
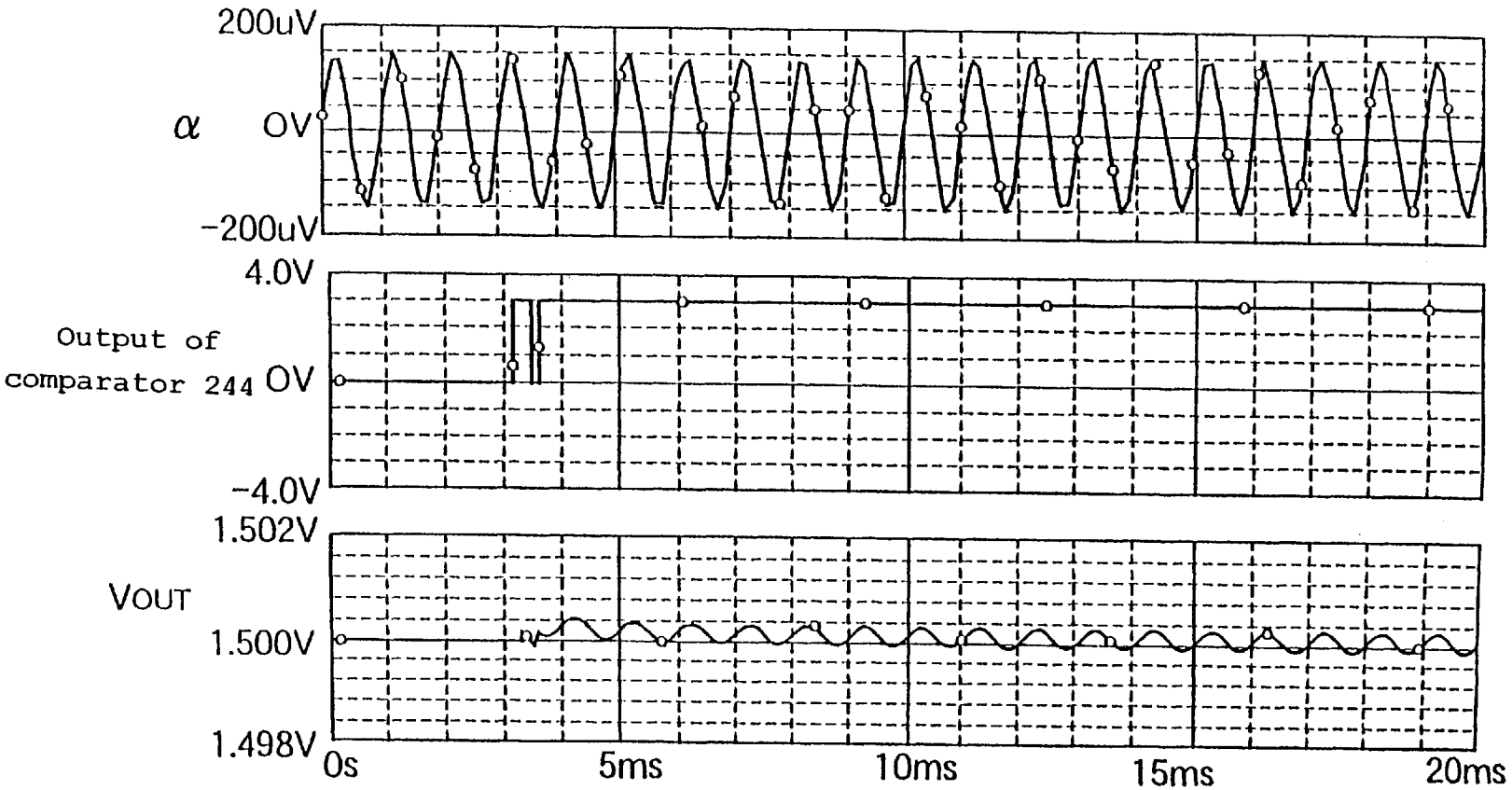
FIG. 10 is a diagram for describing operations of the nose canceller circuit, specifically indicating waveforms of various signals when the level of the microphone's input signal is not lower than the microphone's operating voltage.

Since the frequency response of the filter circuit portion 22 when the output of the comparator 244 is at level H is such as shown in FIG. 8, as shown at the lowest part in FIG. 10, only signal components of a frequency band of 100 Hz through 15 kHz contained in the microphone's input signal α are permitted to pass, thus canceling all the noise in the other frequency bands.

Figure 11:
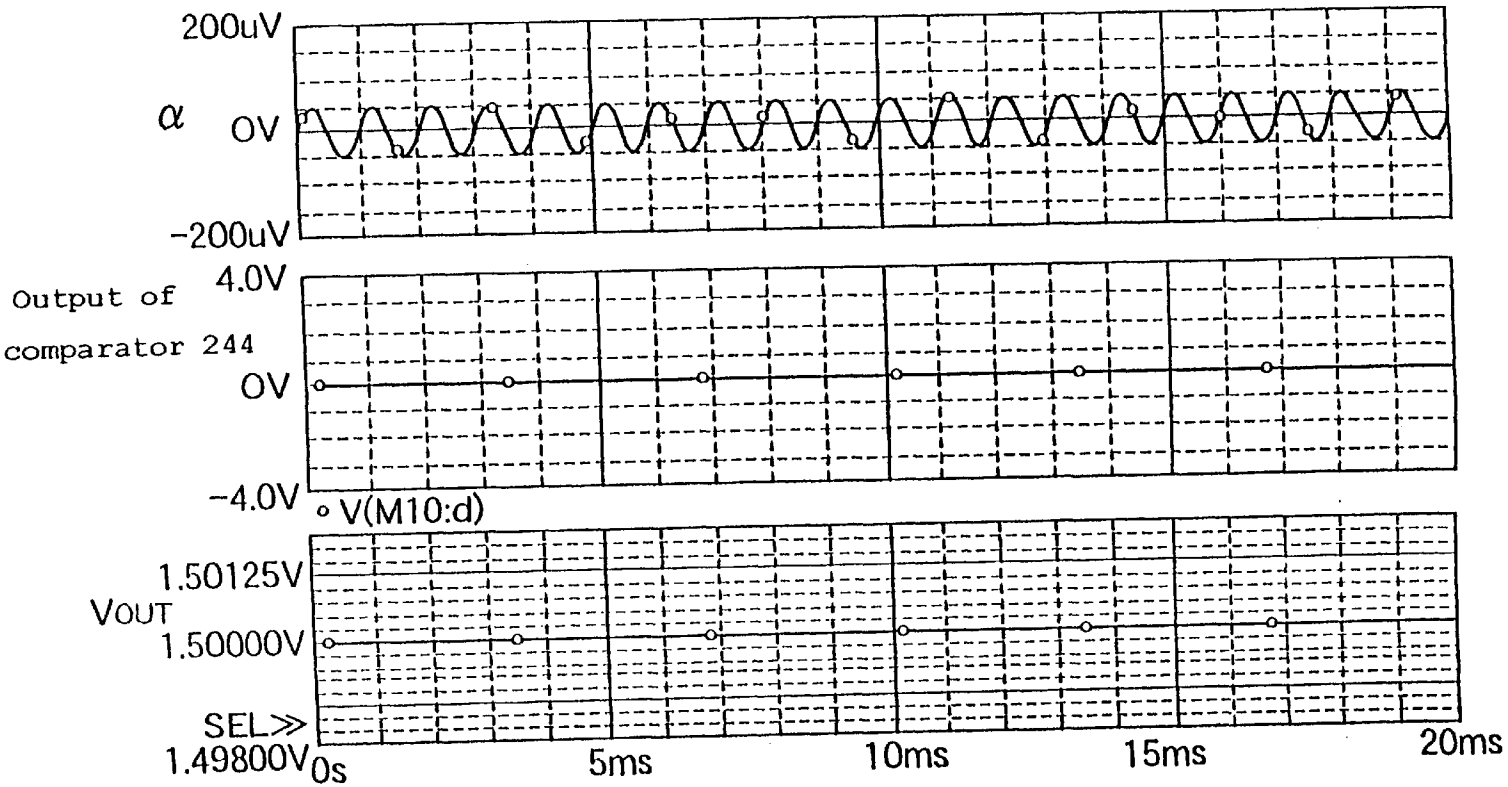
FIG. 11 is a diagram for describing operations of the nose canceller circuit, specifically indicating waveforms of various signals when the level of the microphone's input signal is lower than the microphone's operating voltage.

If, as shown at the highest part in FIG. 10, the level of the microphone's input signal α is less than the microphone s operating voltage (50–100 $\mu V_{O-P}$) on the other hand, even when this signal is input, the integrator circuit 242 does not place an output voltage higher than the reference voltage, so that the comparator 244 stays at level L in output (see the middle part in FIG. 11).

Since the frequency response of the filter circuit portion 22 when the comparator 244 is at level L in output, as shown at the lowest part in FIG. 11, the noise in the wide frequency band contained in the microphone's input signal α' is canceled. As a result, the noise in a low frequency band of 100 Hz through 15 kHz is reduced by at least 20 dB as compared to the case where the microphone's input signal α is at least the microphone's operating voltage.

Figure 12:
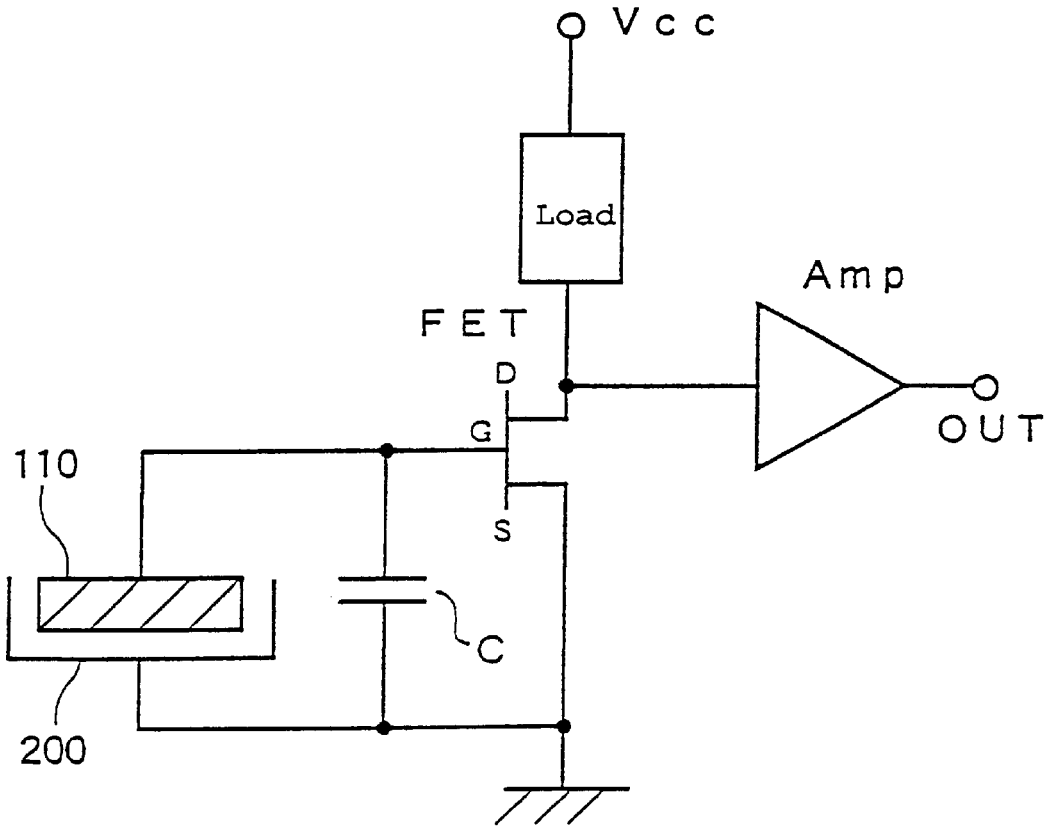
FIG. 12 is an equivalent circuit diagram for showing a prior art type of this semiconductor electret capacitor microphone.

In the semiconductor electret capacitor microphone according to the invention, the fixed electrode is connected to the ground and the vibration membrane 200 is connected to the input electrode 143 of the semiconductor chip 100. Accordingly, the fixed electrode 110 serves as a shielding plate, so that in contrast to the prior art case, the parasitic capacitance C of a few tens of pico-farads below the fixed electrode is eliminated (see FIGS. 5 and 12) and, hence the noise due to this parasitic capacitance C is also eliminated. Accordingly, the sensitivity is improved by 20 dB as compared to the prior art embodiment.

Now that the parasitic capacitance C below the fixed electrode 110 in the semiconductor chip 100 has thus disappeared, this portion need not be left as a dead space, so that part or the whole of the electronic circuit can be arranged there. This dead space can be effectively utilized to form various electronic circuits without an increase in the size of the semiconductor chip 100, thus giving a merit in miniaturization of and performance improvement in the semiconductor electret capacitor microphone.

Further, in this variant, the input circuit 1, the noise canceller circuit 2, and the like for processing a minute level of signal in the necessary electronic circuit 130' are arranged below the fixed electrode 110 and the other circuits such as the A/C converter circuit are arranged at the periphery of the semiconductor chip 100, thus greatly compacting the semiconductor chip itself. Moreover, the noise canceller circuit 2 is included in the necessary electronic circuit 130', so that if the level of the microphone's input signal α is less than the microphone's operating voltage, the noise in a low frequency band contained in this signal can be effectively cancelled.

If the noise canceller circuit 2 is not included in the electronic circuit 130, noise of the low frequency band generated in the electronic circuit 130 is not cancelled by the filter and actually amplified as is and output, which provides a large obstacle in improvement of the S/N ratio of the semiconductor electret capacitor microphone. If no signal is given in particular, only the amplified noise is resultantly output from a speaker and the like.

By the above-mentioned variant, on the other hand, the noise of the low frequency band contained in the microphone's input signal α when no signal is given can be effectively cancelled, thus eliminating all of the above-mentioned problems. Accordingly, this valiant is greatly effective in miniaturization of and performance improvement in the semiconductor electret capacitor microphone.

Although the above-mentioned embodiment has exemplified a bonding wire as the connection means, the invention is not limited to that and of course may use any other means such as a thin-film conductor and the like formed on the case 400. Also, the noise canceller circuit may be of any configuration as far as it has a function of canceling the noise contained in a microphone's input signal input through the input electrode mentioned above, A semiconductor electret capacitor microphone according to claim 1 includes a vibration membrane and a semiconductor chip on which are formed a necessary electronic circuit, a fixed electrode, and a spacer for preserving a predetermined spacing between the fixed electrode and the vibration membrane, in which the fixed electrode is connected to the ground and the vibration membrane is connected to an input electrode of the semiconductor chip.

Accordingly, as shown in FIG. 5, no parasitic capacitance is generated below the fixed electrode, thus enabling greatly reducing a noise level as compared to a prior art case.

Also, a semiconductor electret capacity microphone according to claim 2 includes a vibration membrane, a semiconductor chip on which are formed a necessary electronic circuit, a fixed electrode and a spacer for preserving a predetermined spacing between the fixed electrode and the vibration membrane, and a case for enclosing the semiconductor chip and the vibration membrane, in which the fixed electrode is connected to the ground, the vibration membrane is connected to an input electrode of the semiconductor chip, and the vibration membrane is connected to the input electrode through a conductive spring cover in contact with a vibration-membrane ring to which the vibration membrane is attached with preserved conductivity, an intermediate terminal which is formed on the case and which part of the spring cover comes in contact with, and a connection means for interconnecting the intermediate terminal and the input electrode.

In this semiconductor electret capacitor microphone, since the input electrode of the semiconductor chip and the vibration membrane are electrically interconnected through the vibration-membrane ring, the spring cover, the intermediate terminal, and the connection means, there is no need in particular to change the existing wiring according to the prior art, thus enabling reducing the noise level easily.

Further, a spring cover in a semiconductor electret capacitor microphone according to claim 3 is attached onto a semiconductor ring because this semiconductor ring is fixed to a semiconductor chip, so that the vibration-membrane ring hence the vibration membrane can be easily aligned with the fixed electrode advantageously.

Also, a spacer in a semiconductor electret capacitor microphone according to claim 4 is formed using a photo-engraving process, thus eliminating need to add a discrete step of forming the spacer.

Further, in a semiconductor electret capacitor microphone according to claim 5, at least one opening is formed in a spacer as brought in contact with a non-movable portion of the vibration membrane, it is possible to generate no change in pressure of the space between the vibration membrane and the fixed electrode when the vibration membrane is vibrated by a sound transmitted.

In a semiconductor electret capacitor microphone according to claim 6, part of whole of the necessary electronic circuit is arranged below the fixed electrode, thus enabling miniaturization of the semiconductor chip hence the whole system.

Also, a semiconductor electret capacitor microphone according to claim 7 includes a noise canceller circuit for canceling noise contained in a microphone's input signal input through the input electrode, thus enabling decreasing the noise.

Further, a semiconductor electret capacitor microphone according to claim 8 or 9 uses a noise canceller circuit having such a configuration that if the level of the microphone's input signal is not higher than predetermined value the noise canceller circuit may cancel noise of a wide frequency band contained in that signal, thus enabling decreasing the noise when no signal is given.

What is claimed is:

1. A semiconductor electret capacitor microphone comprising:

a vibration membrane;

an electret formed on a face of said vibration membrane; and a semiconductor chip on which are formed a necessary electronic circuit for a microphone, a fixed electrode, and a spacer for preserving a predetermined spacing between said fixed electrode and a non-movable portion of said vibration membrane, characterized in that said fixed electrode is directly connected to ground potential and the vibration membrane is connected to an input electrode of said semiconductor chip.

2. A semiconductor electret capacity microphone comprising:

a vibration membrane;

an electret formed on a face of said vibration membrane;

a semiconductor chip on which are formed a necessary electronic circuit for a microphone, a fixed electrode and a spacer for preserving a predetermined spacing between said fixed electrode and a non-moveable portion of said vibration membrane; and a case for enclosing the semiconductor chip and the vibration membrane, characterized in that said fixed electrode is directly connected to the ground potential, and said vibration membrane is connected to an input electrode of said semiconductor chip through:

a conductive spring cover in contact with a vibration-membrane ring to which said vibration membrane is attached with preserved conductivity, an intermediate terminal which is formed on said case and which part said spring cover comes in contact with, and a connection means for interconnecting said intermediate terminal and said input electrode.

3. The semiconductor electret capacitor microphone according to claim 2, characterized in that said spring cover is attached onto a semiconductor ring in order to fix said vibration-membrane ring to said semiconductor chip.

4. The semiconductor electret capacitor microphone according to claim 1, 2, or 3, characterized in that said spacer is formed using a photo-engraving process.

5. The semiconductor electret capacitor microphone according to claim 1, 2, or 3, characterized in that at least one opening is formed in said spacer, said spacer being in contact with a non-movable portion of said vibration membrane.

6. The semiconductor electret capacitor microphone according to claim 1, 2, or 3, characterized in that said necessary electronic circuit is partially or wholly arranged below said fixed electrode.

7. The semiconductor electret capacitor microphone according to claim 1, 2, or 3, said necessary electronic circuit includes a noise canceller circuit for canceling noise contained in a microphone's input signal input through said input electrode.

8. The semiconductor electret capacitor microphone according to claim 7, characterized in that said noise canceller circuit has such a configuration that if a level of said microphone's input signal is not higher than a predetermined value said noise canceller circuit cancels noise of a wide frequency band contained in said signal.

9. The semiconductor electret capacitor microphone according to claim 8, characterized in that said noise canceller circuit includes a decider circuit portion for deciding whether a level of said microphone's input signal is at least a microphone's operating voltage and a filter circuit portion for canceling noise contained in said microphone's input signal in various frequency bands based on a decision result by said decider circuit portion in such a manner that said filter circuit portion cancels noise of an ordinary frequency band if said level of said microphone's input signal is at least said microphone's operating voltage and cancels noise of a wide frequency band including a low frequency band if said level of said microphone's input signal is less than said microphone's operating voltage.

* * * * *